US007558517B2

(12) United States Patent
Shirafuji

(10) Patent No.: US 7,558,517 B2
(45) Date of Patent: Jul. 7, 2009

(54) IMAGE FORMING APPARATUS FEATURING ALLEVIATION OF TONER IMAGE DEFORMATION RESULTING FROM A ROTATIONAL SPEED CHANGE OF AN IMAGE BEARING MEMBER

(75) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 329 days.

(21) Appl. No.: 11/565,871

(22) Filed: Dec. 1, 2006

(65) Prior Publication Data

US 2007/0127956 A1 Jun. 7, 2007

(30) Foreign Application Priority Data

Dec. 6, 2005 (JP) ..... 2005-352346

(51) Int. Cl.
*G03G 15/01* (2006.01)

(52) U.S. Cl. ..... 399/302; 399/303

(58) Field of Classification Search ..... 399/299, 399/297, 303, 313, 312, 302, 308
See application file for complete search history.

(56) References Cited

U.S. PATENT DOCUMENTS

| | | | | |
|---|---|---|---|---|
| 4,572,648 | A * | 2/1986 | Toriumi et al. | |
| 4,693,587 | A * | 9/1987 | Shigenobu et al. | |
| 5,819,667 | A * | 10/1998 | Rodi | |
| 2001/0008589 | A1 * | 7/2001 | Sasame et al. | 399/303 |

FOREIGN PATENT DOCUMENTS

| | | |
|---|---|---|
| JP | 62-119565 | 5/1987 |
| JP | 4-21883 | 1/1992 |
| JP | 6-317992 | 11/1994 |
| JP | 11-249459 | 9/1999 |
| JP | 2001-194922 | 7/2001 |

* cited by examiner

*Primary Examiner*—Susan S Lee
(74) *Attorney, Agent, or Firm*—Fitzpatrick, Cella, Harper & Scinto

(57) ABSTRACT

An image forming apparatus is constituted by an image bearing member rotatable while bearing a toner image; and a transfer member for transferring the toner image onto a transfer medium, the transfer member forms a nip with the image bearing member while the transfer medium is movable through the nip in a plane including the nip so that the transfer medium moves in a direction inclined with respect to a movement direction of the image bearing member.

11 Claims, 9 Drawing Sheets

IMAGE FORMING APPARATUS FEATURING ALLEVIATION OF TONER IMAGE DEFORMATION RESULTING FROM A ROTATIONAL SPEED CHANGE OF AN IMAGE BEARING MEMBER

FIELD OF THE INVENTION AND RELATED ART

The present invention relates to an image forming apparatus such as a printer, a copying machine, or a facsimile machine. More specifically, the present invention relates to an image forming apparatus of the type wherein a toner image formed on an image bearing member is transferred onto a transfer material in a transfer nip.

As an image forming apparatus capable of forming a color image, an apparatus having a constitution including a plurality of image forming stations has been conventionally used. At each image forming station, for example, an electrostatic latent image is formed on an image bearing member such as a photosensitive drum by irradiating the image bearing member with a laser beam or light, from a light-emitting element such as LED, which has been optically modulated depending on image information. The electrostatic latent image is developed with developer (toner) by a developing means containing the developer to form a toner image on the photosensitive drum. The plurality of image forming stations forms toner images different in color from each other and the respective color toner images are successively transferred in a multi-transfer manner onto a transfer material conveyed successively to positions corresponding to the respective image forming stations by a transfer material conveying member, thus forming a color image on the transfer material. Alternatively, after the respective color toner images are once transferred onto an intermediary transfer member in a multi-transfer member, they are simultaneously transferred onto the transfer material to form a color image (intermediary transfer method).

As the intermediary transfer member, an endless belt, which is extended around a drive roller for transmitting a driving force and at least one follower roller and the surface of which is moved, is used in many cases. The endless belt as the intermediary transfer member is hereinafter referred to as an "intermediary transfer belt". Further, as the image bearing member, a rotation drum-type electrophotographic photosensitive member is frequently used. Such a photosensitive member is hereinafter referredto as a "photosensitive drum".

Primary transfer from the photosensitive drum to the intermediary transfer belt will be described as an embodiment.

In an image forming apparatus of the type using the intermediary transfer belt, a difference in speed (peripheral speed) between the photosensitive drum and the intermediary transfer belt is provided in order to prevent such a phenomenon, sometimes referred to as a "hollow phenomenon", that a central portion of a thin like toner image is not transferred onto the intermediary transfer belt to cause voids in the toner image to occur (Japanese Laid Open Patent Application Hei 11 249459 and Hei 6 317992).

More specifically, when the toner image is transferred from the photosensitive drum to the intermediary transfer belt, a surface speed (peripheral speed) of the photosensitive drum is higher than that of the intermediary transfer belt. As a result, the toner image transferred onto the intermediary transfer belt is placed in a state of being enlarged along a rotational direction of the intermediary transfer belt. Further, a thickness of the toner image is also decreased by that much, so that an amount of toner directly contacting the surface of the intermediary transfer belt is increased. As a result, an adhesion force of the toner is increased to improve a transfer efficiency of the toner image. This will be described with reference to FIG. 3(*a*). Referring to FIG. 3(*a*), the photosensitive drum has a rotational direction R1 and a peripheral speed V1 and the intermediary transfer belt has a rotational direction R5 and peripheral speed V5, at a transfer nip. At the transfer nip, the photosensitive drum and the intermediary transfer belt have an intersection angle θ of zero degrees, so that the directions R1 and R5 are parallel with each other. By setting the peripheral speeds V1 and V5 to satisfy the relationship: V1<V5, a peripheral speed difference between the intermediary transfer belt and the photosensitive drum is provided only in the rotational direction of the intermediary transfer belt. At the transfer nip, due to the peripheral speed difference, a stress [V5-V1] is caused to act on a toner image t in a direction parallel with the directions R1 and R5. As a result, a transfer efficiency of the toner image t from the photosensitive drum to the intermediary transfer belt is improved to alleviate the occurrence at the hollow phenomenon.

However, because of the difference in surface speed (peripheral surface difference) between the photosensitive drum and the intermediary transfer belt, a frictional force is always generated between the photosensitive drum and the intermediary transfer belt. Due to this frictional force, a friction coefficient is changed between the cases of presence and absence of the developer (toner) between the photosensitive drum and the intermediary transfer belt, so that a rotational speed of the photosensitive drum is changed. For this reason, during formation of the toner image on the photosensitive drum, the toner image is deformed.

SUMMARY OF THE INVENTION

A principal object of the present invention is to provide an image forming apparatus, wherein a toner image carried by an image bearing member is transferred onto a transfer member and a peripheral speed difference is provided between the image bearing member and the transfer member, capable of alleviating deformation of the toner image due to a change in rotational speed of the image bearing member.

According to an aspect of the present invention, there is provided an image forming apparatus comprising:

an image bearing member rotatable while bearing a toner image; and a transfer member for transferring the toner image onto a transfer medium, the transfer member forming a nip with the image bearing member while the transfer medium is movable through the nip in a plane including the nip so that the transfer medium moves in a direction inclined with respect to a movement direction of the image bearing member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

Embodiment 1

Figure 1:
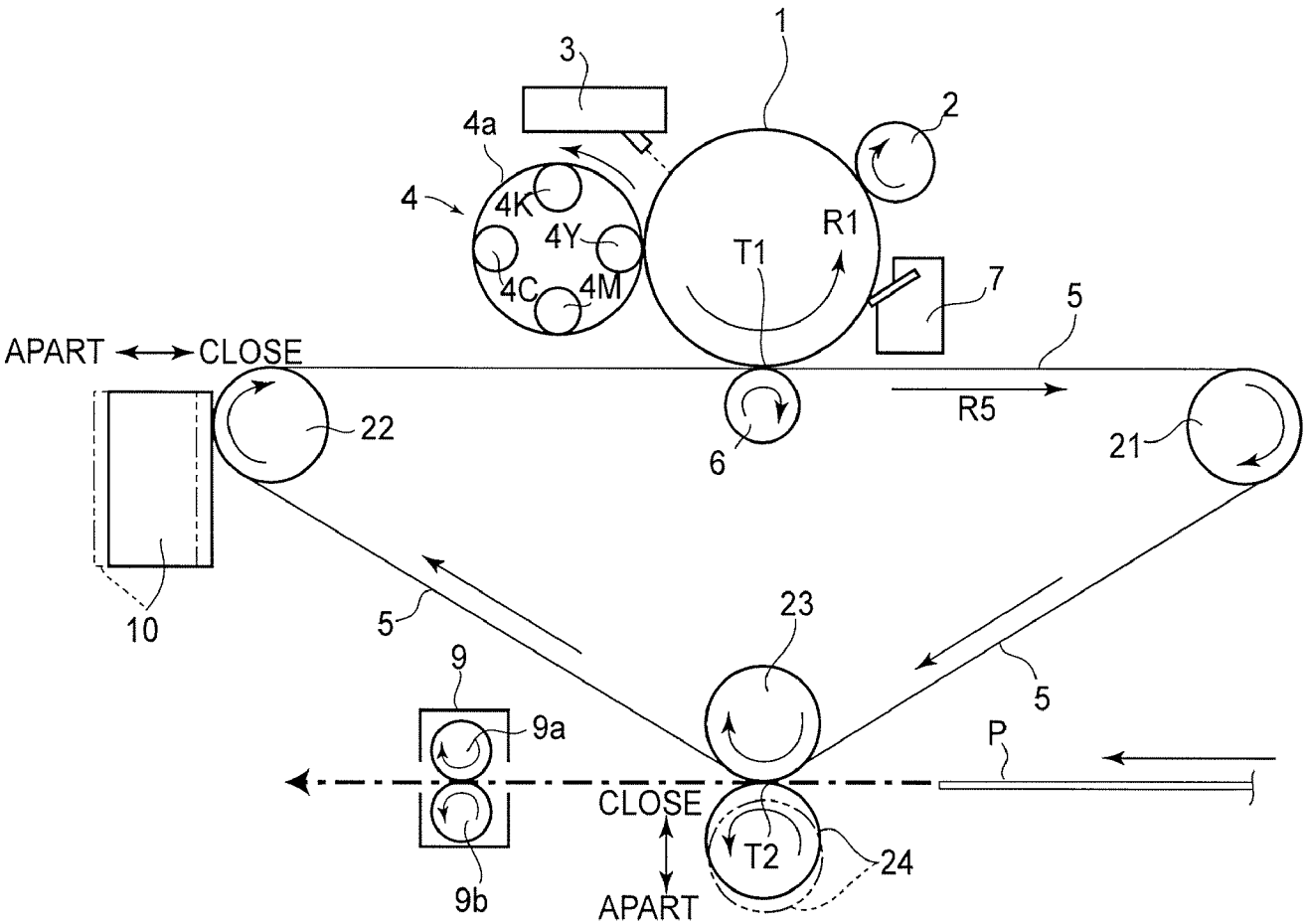
FIG. 1 is a schematic illustration of an image forming apparatus of Embodiment 1.

FIG. 1 is a schematic view for illustrating a general structure of an image forming apparatus according to an embodiment of the present invention. This image forming apparatus is an electrophotographic four (full)-color image forming apparatus (a printer, a copying machine, a facsimile machine, etc.) and includes a drum-type electrophotographic photosensitive member (hereinafter referred to as a "drum") 1 as a rotatable image bearing member (moving image bearing member). The drum 1 is, e.g., constituted by an aluminum-made cylinder and a photosensitive layer of an organic photoconductor (OPC) coated at an outer peripheral surface of the cylinder.

The drum is rotationally driven in a counterclockwise direction indicated by an arrow R1 at a predetermined speed. The surface of the drum 1 is electrically charged uniformly to a predetermined polarity and potential by a charging roller 2 rotating by the rotation of the drum 1. The charged surface of the drum 1 is exposed to light corresponding to image information by an exposure apparatus 3 to form an electrostatic latent image corresponding to an exposure pattern (latent image writing step). In the image forming apparatus in this embodiment, the exposure apparatus 3 is a laser scanning exposure apparatus (laser scanner unit). The exposure apparatus outputs laser light modulated corresponding to image information inputted from an unshown host apparatus, such as a computer, an image reader or a remote facsimile machine, to the image forming apparatus, thus effecting scanning light exposure (laser light irradiation) of the uniformly charged surface of the drum 1. As a result, on the surface of the drum 1, the electrostatic latent image corresponding to the scanning exposure pattern is formed. The electrostatic latent image is developed by a developing apparatus 4. More specifically, toner having an electric charge (charge toner) is electrostatically deposited on the electrostatic latent image, so that the latent image is developed (visualized) as a toner image The developing apparatus 4 includes a rotary 4*a* and four developing devices 4Y, 4M, 4C and 4K which are mounted to the rotary 4*a* and accommodate four toners, respectively, different in color as developer. Toners of yellow (Y), magenta (M), cyan (C), and black (K) are accommodated in the developing devices 4Y, 4M, 4C and 4K, respectively. These four developing devices are selectively moved to a developing position opposite to the drum 1 by rotationally controlling the rotary 4*a*. The electrostatic latent image on the drum 1 surface is developed by the developing device upon being moved to the developing position.

As a rotatable transfer body, an intermediary transfer belt (intermediary transfer member or transfer medium) (hereinafter referred to as a "belt") 5 is disposed so that it contacts the drum (image bearing member) 1, while moving, to form a transfer area between it and the drum 1. The belt 5 is a flexible endless belt of dielectric material and extended around a drive roller (first contact member) 21, a tension roller (stretching roller) 22, and an inner secondary transfer roller 23. Inside the belt 5, a primary transfer roller 5 as a transfer member is disposed and pressed against the drum 1 via the belt 5. A contact area (abutting portion or nip) between the drum 1 and the belt 5 is a primary transfer nip (primary transfer portion) T1.

The belt 5 is rotationally driven (moved) in a clockwise direction indicated by an arrow R5 by the drive roller 21 at a predetermined speed. The toner image formed on the drum 1 is transferred onto the surface of the belt 5 in the primary transfer nip. During this transfer process, a predetermined primary transfer bias is applied between the drum 1 and the transfer roller 6 from an unshown power source portion. From the drum surface after the primary transfer of the toner image on the belt 5, transfer residual toner is removed by a drum cleaning apparatus 7 to clean the drum surface. The thus cleaned drum surface is then subjected to subsequent image formation.

Here, a toner image forming means for forming the toner image on the belt 5 is constituted by the drum 1, the charging roller 2, the exposure apparatus 3, the developing apparatus 4, the transfer roller 6, and the cleaning apparatus 7.

In the case of a full-color image forming mode, the toner image forming step on the drum 1 and the primary transfer step of the toner image onto the belt 5 are successively performed with respect to four colors of yellow, magenta, cyan, and black. As a result, onto the surface of the belt 5, the toner images of four colors of yellow, magenta, cyan and black are transferred in a multi-transfer (superposition) manner, whereby an unfixed full-color toner image is synthetically formed. Incidentally, the order of forming the color toner images is not limited to that described above.

An outer secondary transfer roller 24 is disposed and controlled so as to be close to or apart from a portion, between it and the inner secondary transfer roller 23, through which the belt 5 is moved. The roller 24 is pressed against the belt 5 to create a secondary transfer nip (secondary transfer portion) T2.

A belt cleaning apparatus 10 is disposed and controlled so as to be close to or apart from a portion, between it and the tension roller 22, through which the belt 5 is moved.

During the repetitive primary transfer of the toner images from the drum 1 to the belt 5, the above-described outer secondary transfer roller 24 and the belt cleaning apparatus 10 are held in a state in which they are apart from the belt 5, so as not to disturb the toner image primary-transferred onto the belt 5.

In the full-color image forming mode, in synchronism with the synthetic formation of the unfixed four (full)-color toner images on the belt 5, the outer secondary transfer roller 24 is controlled to be placed in a contact state with the belt 5. As a result, the secondary transfer nip T2 is formed. In the nip T2, from a sheet feeding mechanism (not shown), for example, a recording material (transfer material or transfer medium) P such as paper or a transparent film is introduced at predetermined control timing. The recording material P is nipped and conveyed in the secondary transfer nip T2, and the unfixed four color toner images on the belt 5 are simultaneously transferred onto the recording material P. During this transfer process, between the rollers 23 and 24, a predetermined secondary transfer bias is applied from an unshown power source portion.

The recording material P passing through the secondary transfer nip T2 is separated from the surface of the belt 5 and guided into a fixing apparatus 9 in which the recording material P is heated and pressed between a fixation roller 9*a* and a pressure roller 9*b*. As a result, the multi-toner images of four colors of yellow, cyan, magenta, and black are melted into a mixture to be fixed or the surface of the recording material P as a full-color print image. The recording material P on which the print image is fixed is then discharged (outputted) outside the image forming apparatus.

The surface of the belt 5 after the separation of the recording material is cleaned by removing therefrom the transfer residual toner by means of the belt cleaning apparatus 10 controlled in the contact state with the belt 5, thus being subjected to subsequent image formation.

In a monochromatic image forming mode, only the black toner image is formed on the drum 1, primary-transferred onto the belt 5, secondary-transferred onto the recording material P, and guided into the fixing apparatus 9.

In the above-described image forming apparatus of the intermediary transfer type, in this embodiment, the drum 1 as the image bearing member and the belt 5 as the transfer medium are disposed at an intersection angle θ (deg.).

Figure 2:
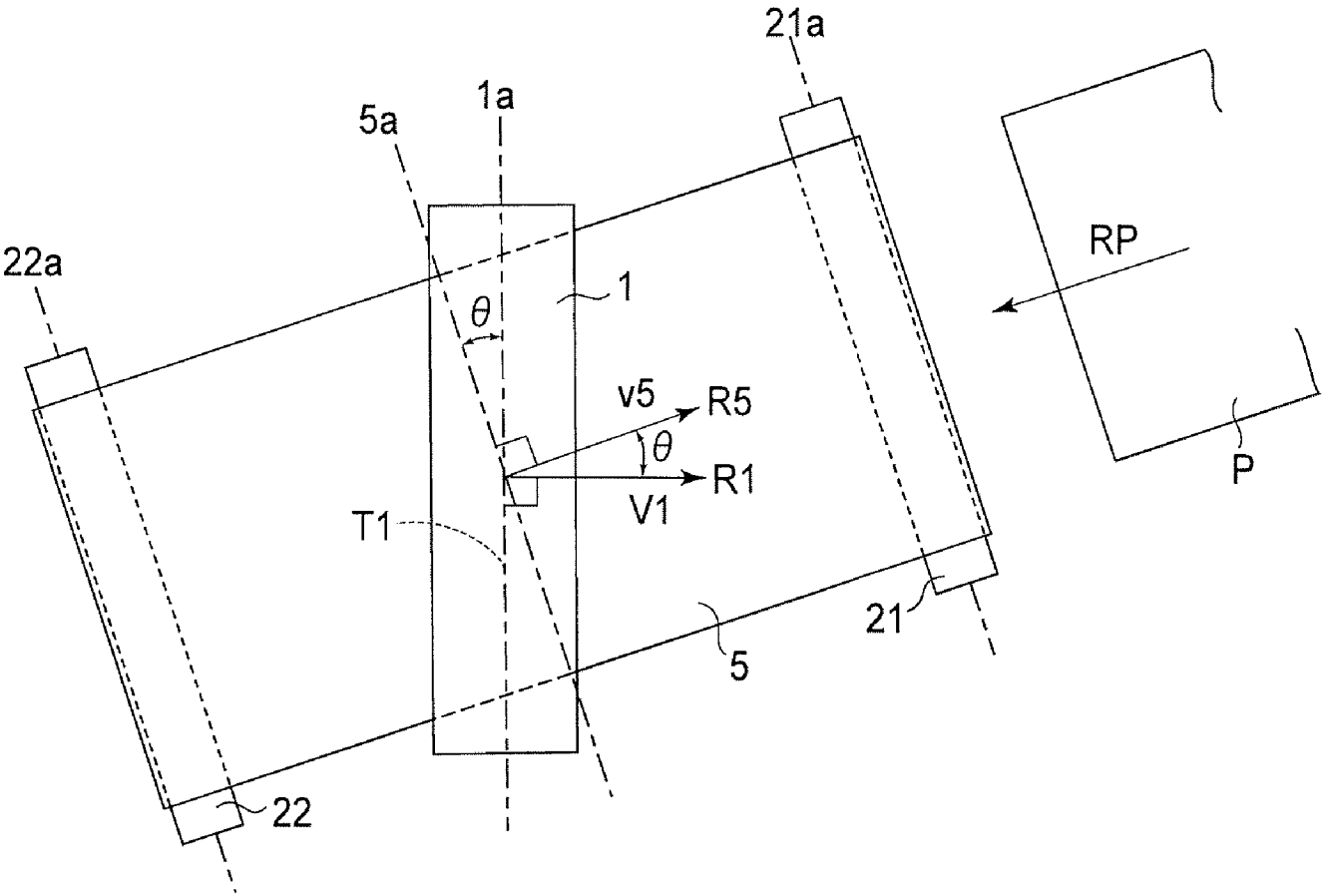
FIG. 2 is a schematic arrangement view of an intermediary transfer belt and a photosensitive drum crossing at an intersection angle θ.

The intersection angle θ is an angle formed between the rotational direction R1 of the device 1 and the rotational direction R5 of the belt 5, in a plane, including the primary transfer nip T1 as the contact area between the drum 1 and the belt 5, parallel with the rotational axis direction of the device 1 as shown in FIG. 2. Referring to FIG. 2, a reference numeral 1*a* represents a rotational axis of the drum 1, a reference numeral 5*a* represents a rotational axis (phantom line) of the belt 5, a reference numeral 21*a* represents a rotational axis of the belt drive roller 21, and a reference numeral 22*a* represents a rotational axis of the tension roller 22. The recording material P is conveyed in a conveyance direction RP parallel with the rotational direction R5 of the belt 5. Further, the primary transfer roller 6 is disposed so that it has a rotational axis parallel with the rotational axis of the drum 1.

Figure 3:
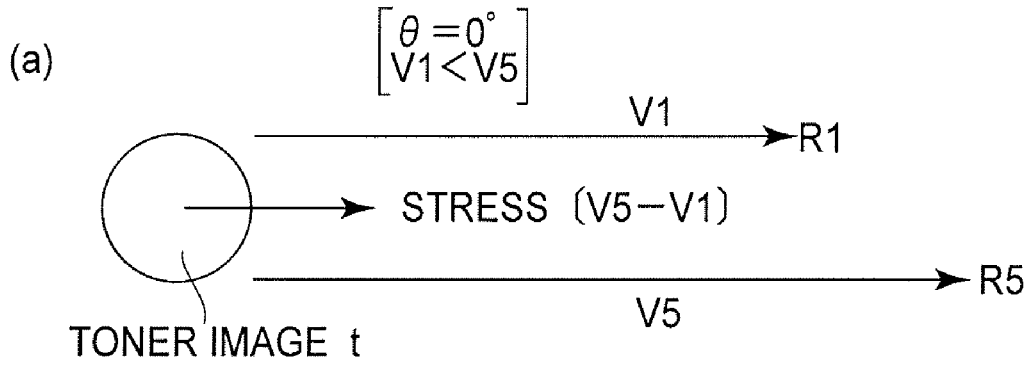
FIGS. 3(*a*) and 3(*b*) are schematic illustrations of the toner image under stress, wherein FIG. 3(*a*) illustrates a state of the toner image under stress when a difference in peripheral speed is given between the photosensitive drum and the intermediary transfer belt, and FIG. 3(*b*) illustrates a state of the toner image under stress in an embodiment of the present invention.
Figure 3:
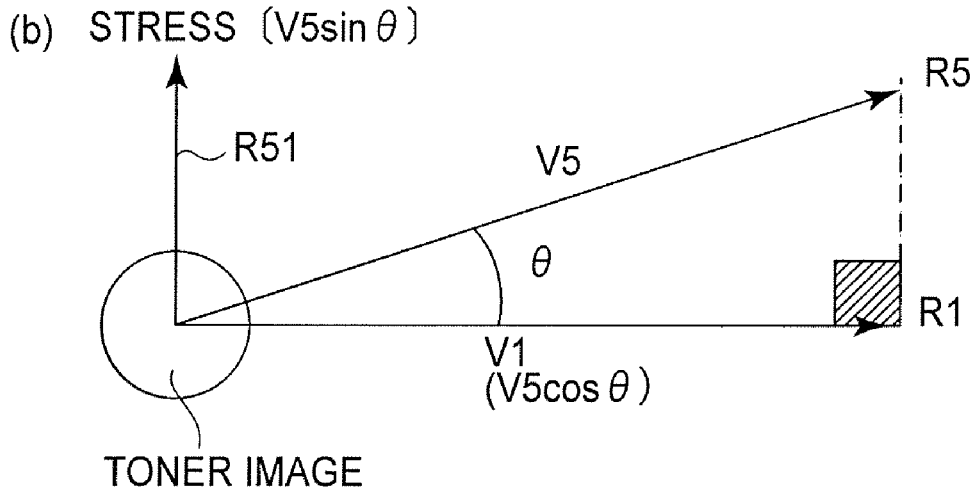

FIG. 3(*a*) shows a case where a peripheral speed difference [V5-V1] is provided only in the rotational direction of the belt 5 by setting conditions including the intersection angle θ=0, i.e., the direction R1 being parallel with the direction R5, and V1<V5 where V1 represents a peripheral speed of the drum 1 and V5 represents a peripheral speed of the belt 5. As a result, a transfer efficiency of the toner image t from the drum 1 to the belt 5 is ensured. However, in this case, deformation of the image is liable to occur as described above.

In this embodiment, in order to obtain a light transfer efficiency by preventing the occurrence of voids in the toner image, and while preventing the deformation of the toner image, an absolute value |V5| of the peripheral speed V5 of the belt 5 and the intersection angle θ (0 deg. <θ<90 deg.) described above are set to satisfy the following relationship:

$$0.36(\text{mm/sec}) \leqq |V5| \times \sin\theta \leqq 6.5(\text{mm/sec}).$$

Here, the value |V5|×sin θ represents a magnitude of a component R51 (FIG. 3(*b*)), in a direction perpendicular to the moving direction of the drum 1, of the peripheral speed V5 in the primary transfer nip T1 of the belt 5.

Further, in this embodiment, as shown in FIG. 3(*b*), the peripheral speed V5 of the belt 5 is set so that its projection component V5 cos θ is equal to or substantially equal to the peripheral speed V1 of the drum 1 in the rotational direction R1 of the drum 1. In this embodiment, the peripheral speed V1 is 130 mm/sec and the peripheral speed V5 is 136.2 mm.

More specifically, the belt moving direction is inclined with respect to the drum moving direction in a plane, parallel with the rotational direction of the drum 1, including the primary toner nip T1 as the contact area between the drum 1 as the image bearing member and the belt 5 as the intermediary transfer member (transfer medium). Further, in the primary transfer nip T1, a component of the speed of the belt 5 in the drum moving direction is substantially equal to the speed of the drum 1.

Herein, in the present invention, the term "substantially equal" means a range of being almost equal or capable of being regarded as being almost equal or within a tolerable range (e.g., within ±0.5%).

In this embodiment, in the drum rotational direction R1 in the primary transfer nip T1, there is substantially no peripheral speed difference between the drum 1 and the belt 5, so that the rotational speed V1 of the drum 1 is not changed depending on the peripheral speed difference with the belt 5. Accordingly, it is possible to alleviate the deformation of image resulting from the change in rotational speed of the drum 1.

On the other hand, with respect to the drum rotational direction R1 in the primary transfer nip T1, a stress V5 sin θ for the perpendicular component R51 is exerted on the toner image t. More specifically, the peripheral speed difference is provided in a direction perpendicular to the rotational direction of the drum 1. By the peripheral speed difference (stress), an adhesion force between the toner image t and the belt 5 is increases, so that a transfer efficiency from the drum 1 to the belt 5 is improved. As a result, the occurrence of voids in the toner image is alleviated.

Figure 4:
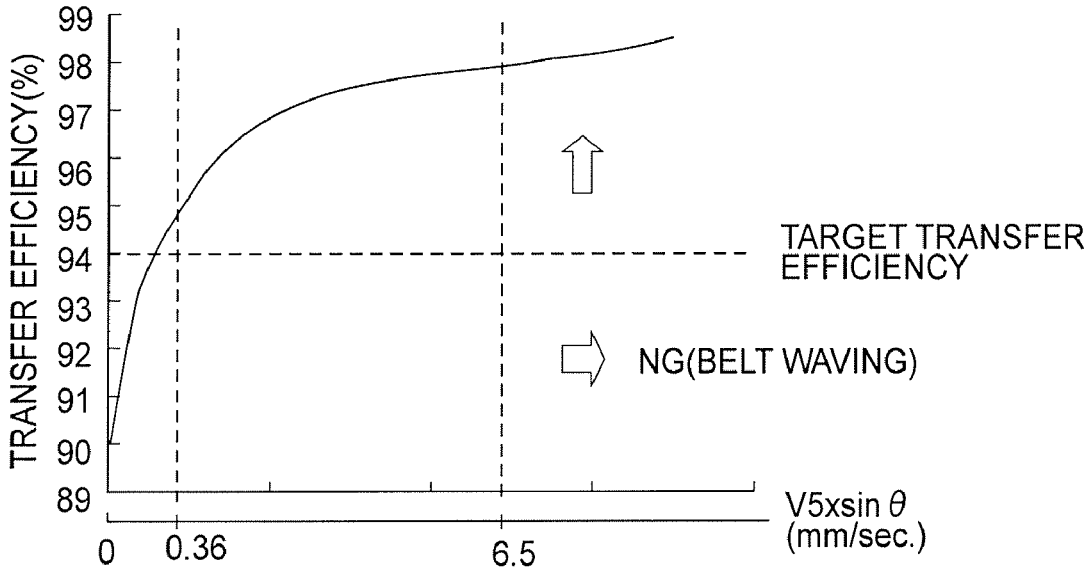
FIG. 4 is a graph showing a relationship between an intersection angle θ (peripheral speed difference) and a transfer efficiency.

FIG. 4 shows a relationship between |V5|×sin θ and the transfer efficiency.

As shown in FIG. 4, when a target transfer efficiency is taken as 94% or more, it is at least required that 0.36 (mm/sec) ≦|V5|×sin θ is satisfied in order to ensure the transfer efficiency of 94% or more. On the other hand, when |V5|×sin θ is excessively large, stress in the perpendicular direction is also excessively increased, thus resulting in an occurrence of waving of the belt 5.

For these reasons, |V5|×sin θ may preferably satisfy the following relationship:

$$0.36\ (\text{mm/sec}) \leqq |V5| \times \sin\theta \leqq 6.5(\text{mm/sec}).$$

For example, when $|V5|\times\sin\theta=2.6$ (mm/sec), the intersection angle θ is 1.14 degrees.

The conveyance direction RP of the recording material P is parallel with the rotational direction of the belt 5 as shown in FIG. 2. This is because the conveying direction of the recording material P is intended to be stably ensured in the secondary transfer nip T2.

Figure 5:
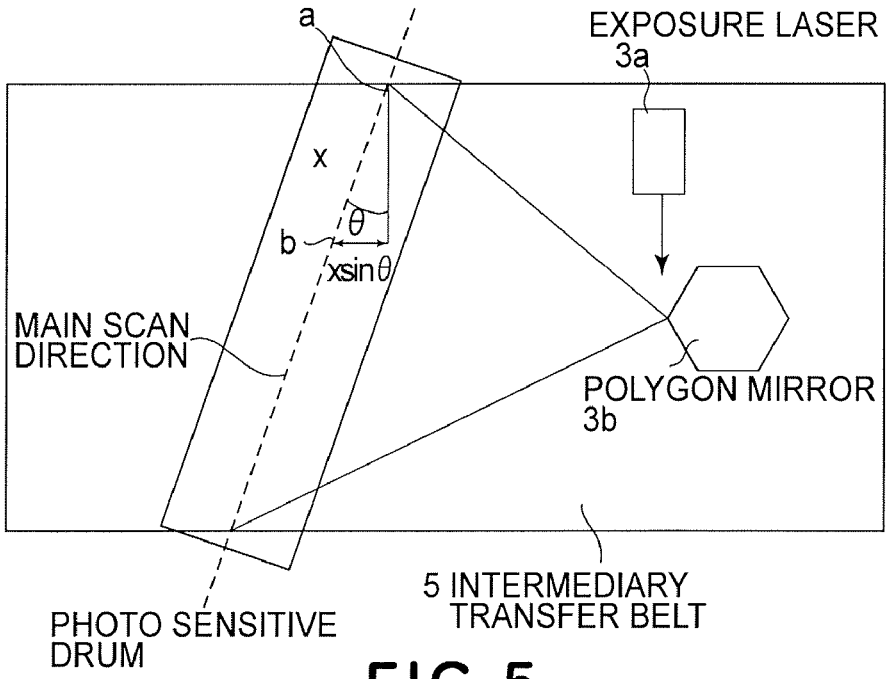
FIG. 5 is a schematic illustration of timing of writing a latent image on the photosensitive drum in a latent image writing step.

In the latent image forming step, as shown in FIG. 5, writing of the latent image is set so that a writing time at a point b distant from a writing start point a by x in a main scanning direction of the drum 1 is earlier than that at the writing start point a by a time corresponding to ×sin θ. The laser exposure apparatus 3 includes an exposure laser 3*a* and a polygon mirror 3*b* to be rotationally driven, as shown in FIG. 5. Further, a length of the latent image in the rotational direction of the drum 1 is extended to 1/con θ times the length of a desired image on the belt 5 in the belt rotational axis direction.

Further, in this embodiment, speeds (absolute values) of the latent image writing, the photosensitive drum rotation, the intermediary transfer belt rotation, and the recording material conveyance are taken as V3, V1, V5 and VP, respectively. Further, relationships among these speeds are set as follows.

$$V3=V1=V5=VP \qquad \text{Example 1:}$$

$$V3=V5=VP\geqq V1 \qquad \text{Example 2:}$$

In the case of the setting of Example 1, the drum 1 provides the intersection angle θ with respect to the belt 5 and V1=V5, so that an image on the drum 1 is enlarged. However, when the image is transferred from the drum 1 to the belt 5, the enlarged portion is reduced by the same degree in a quite opposed manner to the case of the image on the drum 1. In other words, a final image does not expand and contract, so that image formation can be effected at the setting of Example 1.

Similarly, in the case of setting of Example 2, even when the speeds V2, V5 and VP are larger than the drum speed V1, only the image on the D1 is changed. However, the final image does not expand and contract since V3=V5=VP is maintained. Thus, image formation can be effected even when the speeds V3, V5 and VP is different from the drum speed V1 so long as the relationship: V3=V5=VP as in the setting of Example 2 is satisfied.

Further, in the cases of Examples 1 and 2, the belt speed V5 is equal to the recording material conveyance speed VP and the recording material is conveyed in parallel with the belt, so that conveyance of the recording material in the secondary transfer nip T2 is stabilized.

Embodiment 2

Figure 6:
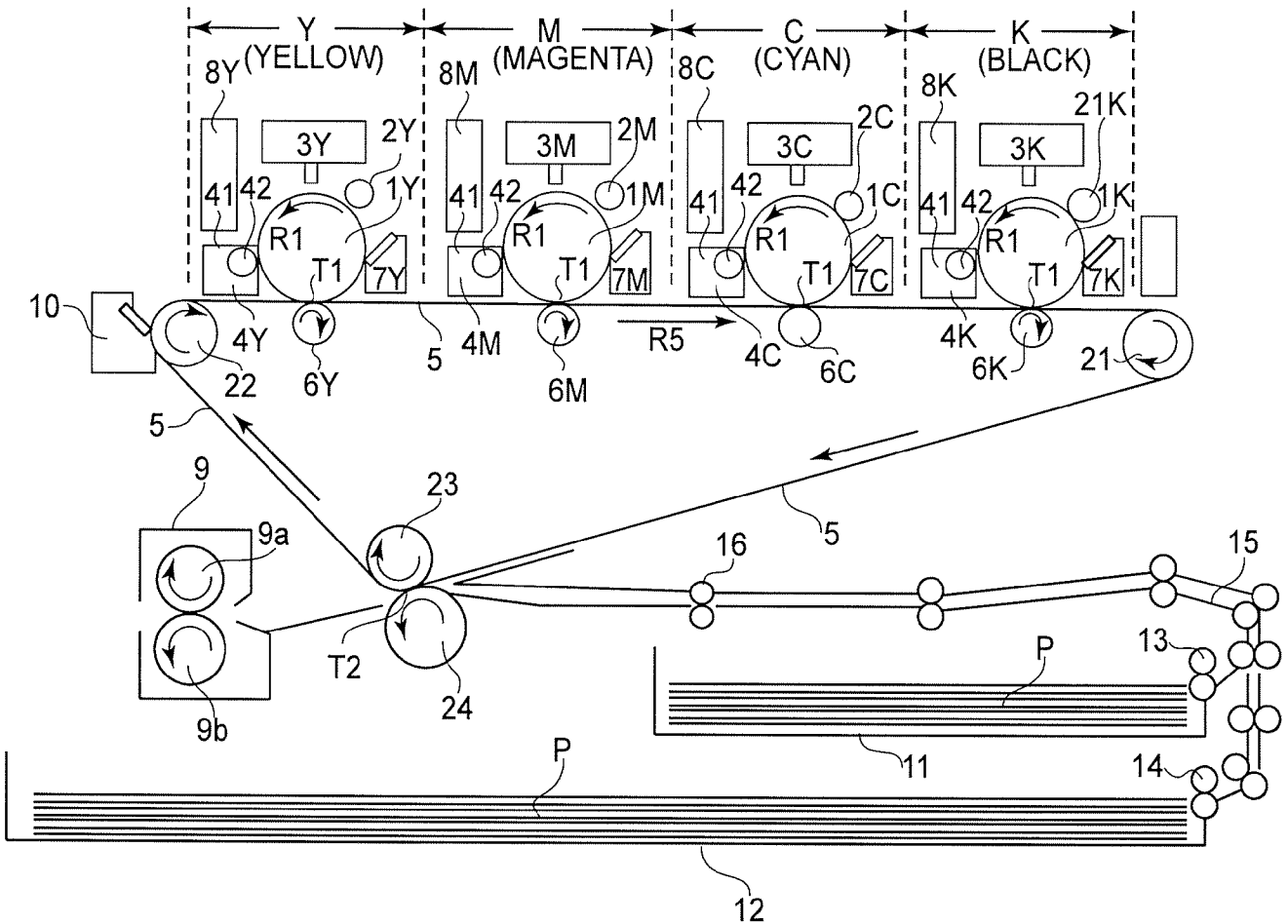
FIG. 6 is a schematic illustration of an image forming apparatus of Embodiment 2.

FIG. 6 is a schematic view for illustrating a general structure of an image forming apparatus according to a second embodiment of the present invention. This image forming apparatus is also an electrophotographic four (full)-color image forming apparatus but has a tandem constitution employing a plurality of drums (electrophotographic photosensitive member) 1Y, 1M, 1C and 1K.

Referring to FIG. 6, the image forming apparatus includes four(-color) image forming station Y, M, C and K for forming color toner images of yellow, magenta, cyan and black, disposed from left to right in the drawing.

The respective color toner images formed at these image forming stations Y, M, C and K are successively primary-transferred onto a belt (intermediary transfer belt) 5 as a transfer medium in a superposition manner to synthetically form a full-color unfixed toner image. Thereafter, the multi-toner image components are simultaneously transferred onto a recording material P. The thus secondary-transferred four color toner images are fixed on the recording material P to obtain a full-color image.

The image forming stations Y, M, C and K includes the drums as the image bearing members, i.e., the drum-type electrophotographic photosensitive members 1Y, 1M, 1C and 1K, respectively. Each of the drums 1Y, 1M, 1C and 1K is rotationally driven in a counterclockwise direction indicated by an arrow R1 at a predetermined peripheral speed. After the drum surface is electrically charged uniformly by a charging roller 2Y, 2M, 2C and 2K, it is subjected to laser scanning exposure by a laser scanning exposure apparatus to form thereon an electrostatic latent image corresponding to an associated color.

The electrostatic latent image formed on each of the drums 1Y, 1M, 1C and 1K is developed into a toner image by depositing thereon toner of the associated color by each of developing devices 4Y, 4M, 4C and 4K containing toners of yellow, magenta, cyan and black, respectively.

Below the above-described four image forming stations Y, M, C and K, the belt (intermediary transfer belt) 5 as the transfer medium is disposed. The belt 5 is extended around a drive roller 21, a tension roller 22, and an inner secondary transfer roller 23 and is rotationally driven (moved) in a clockwise direction indicated by an arrow R5 at a predetermined peripheral speed.

Further, inside the belt 5, primary transfer rollers 6Y, 6M, 6C and 6K as transfer members are disposed at positions opposite to the drums 1Y, 1M, 1C and 1K, respectively. The belt 5 is pressed against the surfaces of the drums 1Y, 1M, 1C and 1K by these primary transfer rollers 6Y, 6M, 6C and 6K, respectively. As a result, a primary transfer nip T1 as a contact area is created between the belt 5 and each of the drums 1Y, 1M, 1C and 1K.

The image forming stations and the primary transfer rollers constitute a toner image forming means for forming toner images on the belt 5.

At a position, corresponding to the inner secondary transfer roller 23, outside the belt 5, an outer secondary transfer roller 24 is disposed. The belt 5 is pressed against the roller 24 by the roller 23 to form a secondary transfer nip T2 between it and the roller 24.

The respective color toner images formed on the drums 1Y, 1M, 1C and 1K are successively primary-transferred onto the belt 5 in the respective primary transfer nips T1 by applying a transfer bias to the primary transfer rollers 6Y, 6M, 6C and 6K, whereby the four color toner images are superposed on the belt 5. Transfer residual toners remaining on the surfaces of the respective drums 1Y, 1Y, 1C and 1K after the primary transfer of the toner images on the belt 5 are removed by drum cleaning apparatuses 7Y, 7M, 7C and 7K to be subjected to subsequent toner image formation.

The four color toner images superposed on the belt 5 as described above, are conveyed to the secondary transfer nip T2 by the rotation of the belt 5.

On the other hand, the recording material P accommodated in a paper (sheet)-feeding cassette 11 or 12 is fed sheet by sheet by a paper-feeding roller 13 or 14 to registration rollers 16 through a conveyance passage provided with conveyance rollers. The recording material P is fed to the secondary transfer nip T2 by the registration rollers 16 at the same timing as formation of the four color toner images on the belt 5 in the above-described manner. During the passing of the recording material P through the secondary transfer nip T2, a transfer bias is applied between the inner secondary transfer roller 23 and the other secondary transfer roller 24, whereby the four color toner images are simultaneously transferred onto the belt 5.

The recording material P passing through the secondary transfer nip T2 is separated from the surface of the belt 5 and guided into a fixing apparatus 9 in which the recording material P is heated and pressed between a fixation roller 9*a* and a pressure roller 9*b*. As a result, the multi-toner images of four colors of yellow, cyan, magenta, and black are melted into a mixture to be fixed or the surface of the recording material P as a full-color print image. The recording material P on which the print image is fixed is then discharged (outputted) outside the image forming apparatus.

The surface of the belt 5 after the separation of the recording material is cleaned by removing therefrom the transfer residual toner by means of the belt cleaning apparatus 10, thus being subjected to subsequent image formation.

In FIG. 6, each of toner supply container 8Y, 8M, 8C and 8K contains toner to be supplied to an associated developing apparatus 4Y, 4M, 4C or 4K.

Each of the developing apparatuses 4Y, 4M, 4C and 4K for respective colors feed toner to an associated developing sleeve 42 while stirring the toner by a toner feeding mechanism (not shown) in an associated developer container, and applies the toner in a thin layer onto an outer peripheral surface of the developing sleeve 42 by a regulation blade (not shown) pressed against the outer peripheral surface of the developing sleeve 42. Electric charges are imparted to the toner by the above-described stirring, conveyance, and regulation. The charge-imparted toner is deposited on the electrostatic latent image on the drum by applying a developing bias consisting of a DC bias superposed with an AC bias to the developing sleeve 42 to develop the electrostatic latent image. The developing sleeve 42 is disposed opposite to the drum with a small spacing (about 30 μm).

In this embodiment, a peripheral speed V1 of the four drums 1Y, 1M, 1C and 1K is 130 mm/sec, and a peripheral speed V5 of the belt 5 is 136.2 mm/sec. Further, as shown in FIG. 7, the above-described four drums 1Y, 1M, 1C and 1K and the belt 5 are disposed so as to satisfy the following relationship:

$$0.36(\text{mm/sec}) \leqq |V5| \times \sin\theta \leqq 6.5(\text{mm/sec}).$$

In this embodiment, the image forming apparatus including the single image forming station used in Embodiment 1 is extended to the image forming apparatus including the four image forming stations. Other settings are the same as those described in Embodiment 1. Further, the primary transfer rollers 6Y, 6M, 6C and 6K are disposed so that each of rotational axes of the primary transfer rollers is parallel with an opposing rotational axis of an associated drum.

Figure 7:
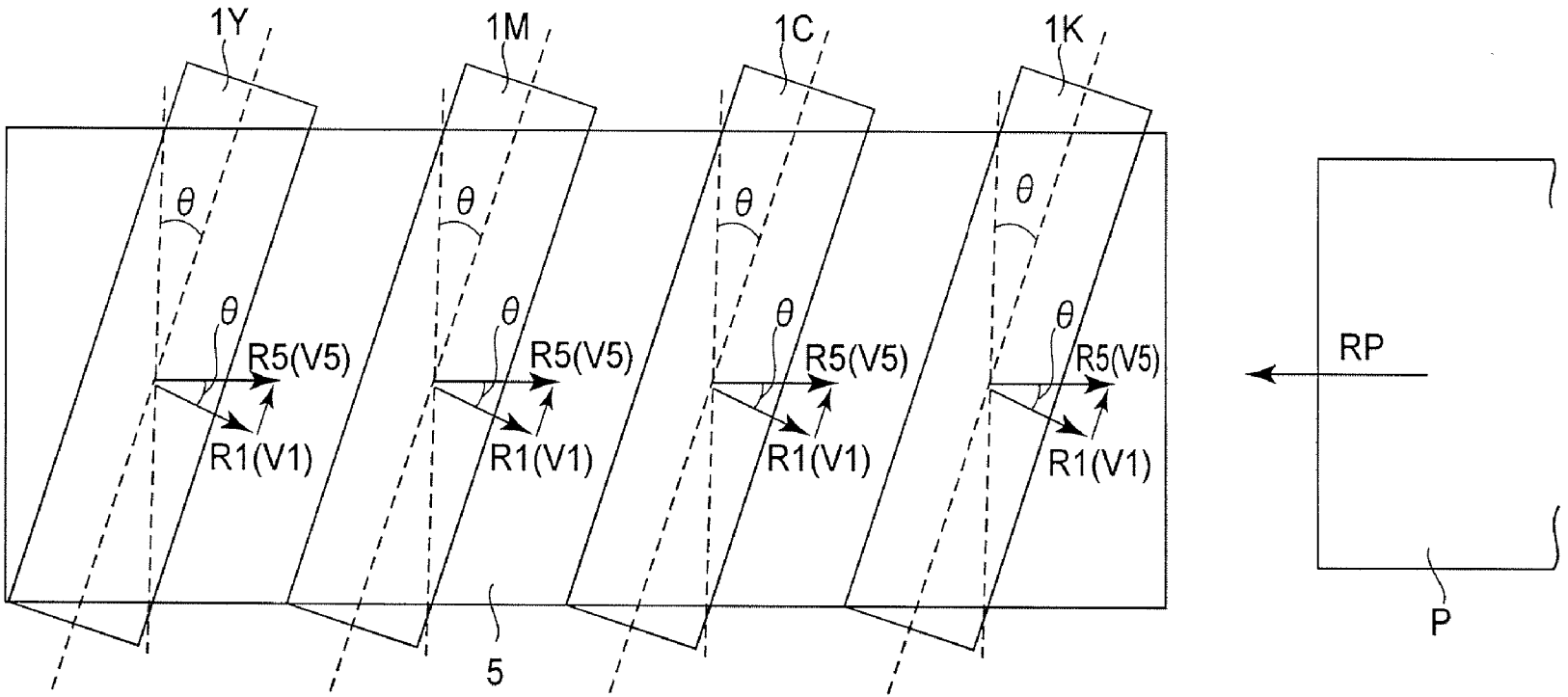
FIG. 7 is a schematic illustration of an embodiment of an arrangement of an intermediary transfer belt and photosensitive drums with an intersection angle θ in an image forming apparatus including four image forming stations in Embodiment 2.
Figure 8:
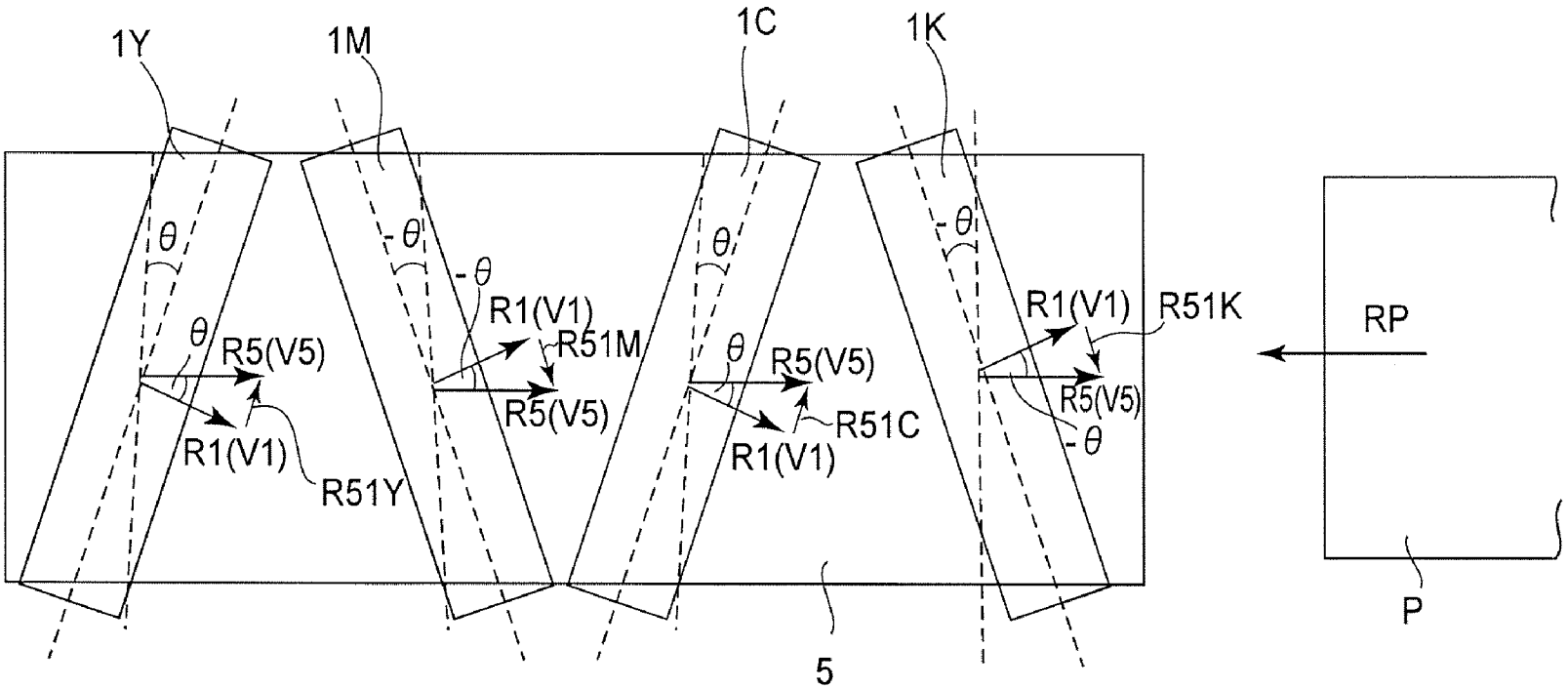
FIG. 8 is a schematic illustration of another embodiment of an arrangement of an intermediary transfer belt and photosensitive drums with an intersection angle θ in an image forming apparatus including four image forming stations in Embodiment 2.

In the case of the embodiment shown in FIG. 7, on the belt 5, a stress V5 sin θ is exerted from each of the drums 1Y, 1M, 1C and 1K in the same direction, causing waving of the belt 5. For this reason, in this embodiment, as shown in FIG. 8, the drums 1Y, 1M, 1C and 1K and the belt 5 are disposed so as to satisfy the relationship: 0.36 (mm/sec)≦|V5|×sin θ≦6.5 (mm/sec) in a shape such that adjacent drums constitute a chevron-like shape. As a result, it is possible to alleviate waiving of the belt.

In FIG. 8, components of the speed V5 of the belt 5 perpendicular to the moving directions of the photosensitive drum 1Y (first image bearing member), the photosensitive drum 1M (second image bearing member), the photosensitive drum 1C, and the photosensitive drum 1K are taken as R51Y, R51M, R51C and R51K, respectively.

The speed components R51Y and R51C are substantially equal to each other, and those R51M and R51K are also substantially equal to each other. More specifically, these speed component values are within ±5% of each other. In other words, the sum of the values of R51Y, R51M, R51C and R51K is substantially zero (mm/sec). Here, the term "substantially zero" means that the value is within ±0.2 (mm/sec).

Incidentally, even when the drums are disposed in the above-described chevron-like shape as shown in FIG. 8, the primary transfer rollers 6Y, 6M, 6C and 6K are disposed in parallel with the opposing drums 1Y, 1M, 1C and 1K, respectively, with respect to their rotational axes.

In this embodiment, the speed component R51Y in a (first) contact area between the drum 1Y and the belt 5 and the speed component R51M in a (second) contact area between the drum 1M and the belt 5 are substantially equal in magnitude to each other but opposite in direction to each other, i.e., different in direction from each other.

Figure 9:
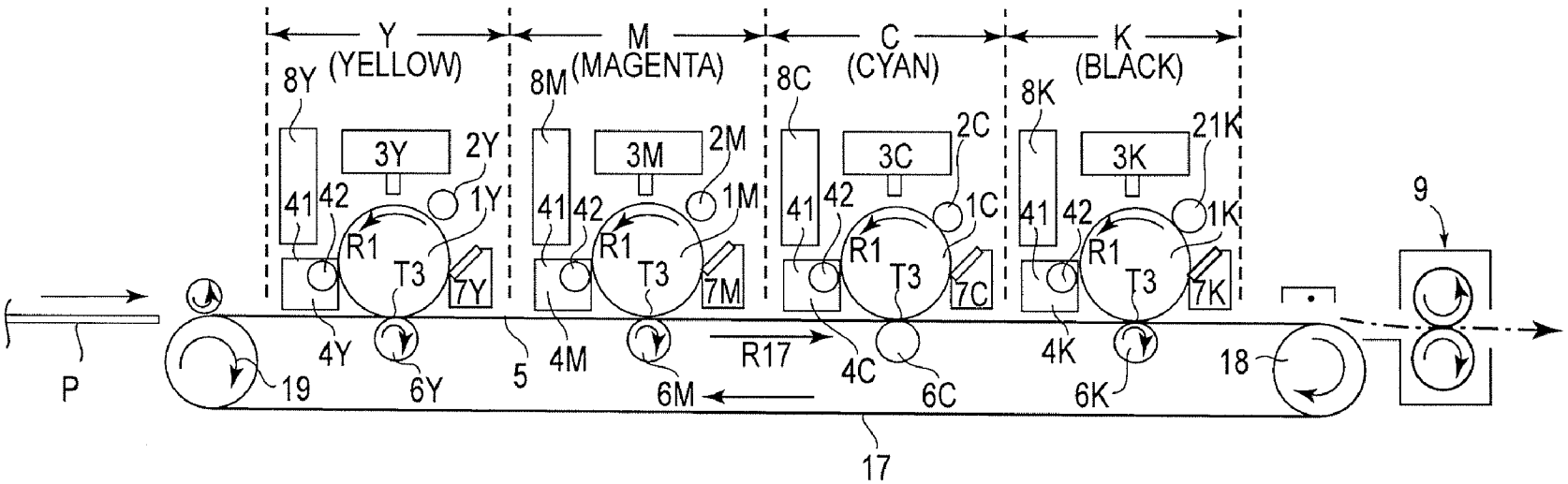
FIG. 9 is a schematic illustration of an image forming apparatus of Embodiment 2.

The conveyance direction RP of the recording material P is parallel with the rotational direction of the belt 5 as shown in FIGS. 8 and 9. This is because the conveying direction of the recording material P is intended to be stably ensured in the secondary transfer nip T2.

Embodiment 3

FIG. 9 is a schematic view for illustrating a general structure of an image forming apparatus according to a third embodiment of the present invention. The image forming apparatus has the same structure as that in Embodiment 1 except that the intermediary transfer belt 5 disposed below the four image forming stations Y, M, C and K in Embodiment 1 is changed to a transfer belt 17 as a recording material conveying member for carrying and conveying a recording material (transfer material) P.

The transfer belt 17 is a flexible endless belt of a dielectric material and is extended around a drive roller 18 and a turn roller 19, and an inner secondary transfer roller 23 and is rotationally driven (moved) in a clockwise direction indicated by an arrow R17 at a predetermined peripheral speed.

The four image forming stations Y, M, C and K have the same constitution as that of those in Embodiment 1, thus being omitted from redundant explanation.

Further, inside the transfer belt 17, transfer rollers 6Y, 6M, 6C and 6K as transfer members are disposed at positions opposite to the drums 1Y, 1M, 1C and 1K, respectively. The transfer belt 17 is pressed against the surfaces of the drums 1Y, 1M, 1C and 1K by these transfer rollers 6Y, 6M, 6C and 6K, respectively. As a result, a transfer nip T3 is created between the transfer belt 17 and each of the drums 1Y, 1M, 1C and 1K.

The transfer medium (transfer material or sheet) P which has been separated and fed sheet by sheet from an unshown paper (sheet)-feeding mechanism is conveyed on the transfer belt 17 to an end portion of a first image forming station Y. The transfer belt 17 electrostatically attracts and holds the fed recording material P or holds the recording material P with a chuck and successively conveys the recording material P to the transfer nips T3 of the respective image forming stations Y, M, C and K. As a result, onto the same recording surface of the recording material P, four color toner images of yellow, magenta, cyan and black are successively transferred in a superposition manner and in an alignment state to synthetically form an unfixed full-color toner image on the recording material P.

The conveyed recording material P passing through the transfer nip T3 of the four image forming station K is separated from the transfer belt 17 and guided into a fixing apparatus 9 by which the unfixed toner image is subjected to heat-fixing process, and the recording material P is discharged out of the fixing apparatus 9.

Figure 10:
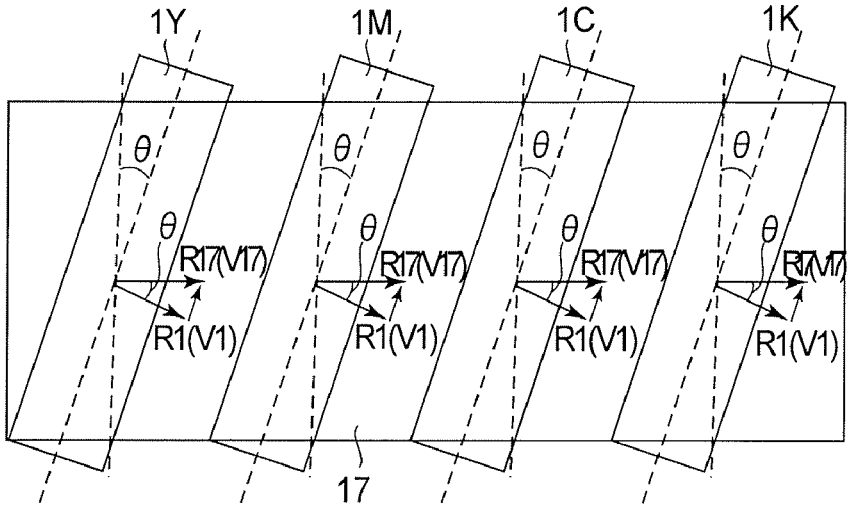
FIG. 10 is a schematic illustration of an embodiment of an arrangement of an intermediary transfer belt and photosensitive drums with an intersection angle θ in an image forming apparatus including four image forming stations in Embodiment 3.

In this embodiment, a peripheral speed V1 of the four drums 1Y, 1M, 1C and 1K is 130 mm/sec, and a peripheral speed V17 of the transfer belt 17 is 136.2 mm/sec. Further, in the image forming apparatus of this embodiment, as shown in FIG. 10, the above-described four drums 1Y, 1M, 1C and 1K and the transfer belt 17 are disposed so as to satisfy the following relationship:

$$0.36(\text{mm/sec}) \leqq |V17| \times \sin\theta \leqq 6.5(\text{mm/sec}).$$

Here, $|V17| \times \sin\theta$ represents a magnitude of a component, of the peripheral speed V17 in the transfer nip T3, perpendicular to the moving direction of each of the drums 1Y, 1M, 1C and 1K at the contact portion, i.e., in the transfer nip T3.

Other settings are the same as those described in Embodiment 1.

More specifically, in the transfer nip T3 as the contact area between each of the drums 1Y, 1M, 1C and 1K as the image bearing member and the transfer belt 17 as the recording material transfer means (transfer medium), the transfer belt moving direction is inclined with respect to the drum moving direction. Further, in the transfer nip T3, a component of the speed of the transfer belt 17 in the drum moving direction is substantially equal to the speed of each of the drums.

Further, the primary transfer rollers 6Y, 6M, 6C and 6K are disposed so that each of rotational axes of the transfer rollers is parallel with an opposing rotational axis of an associated drum.

Figure 11:
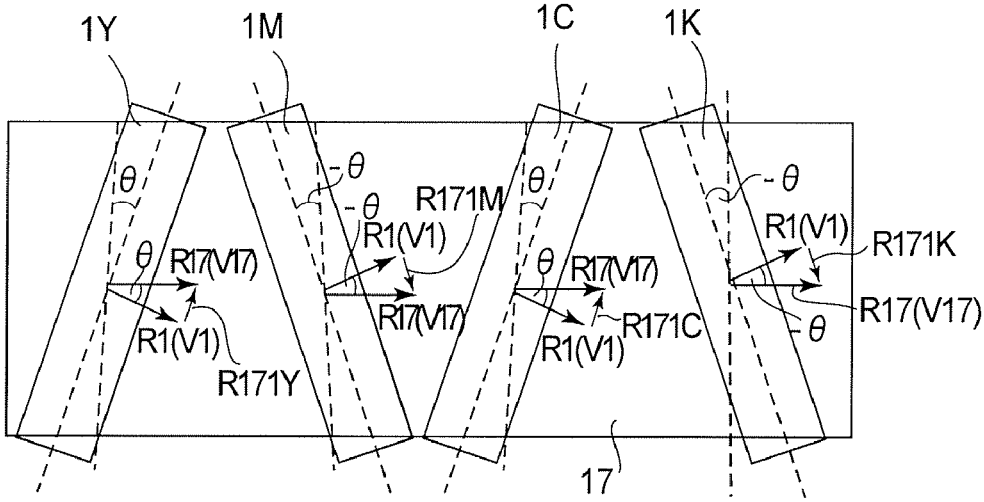
FIG. 11 is a schematic illustration of another embodiment of an arrangement of an intermediary transfer belt and photosensitive drums with an intersection angle θ in an image forming apparatus including four image forming stations in Embodiment 3.

Further, in this embodiment, as shown in FIG. 11, the drums 1Y, 1M, 1C and 1K and the transfer belt 17 are disposed so as to satisfy the relationship: 0.36 (mm/sec)$\leqq |V17| \times \sin\theta \leqq$6.5 (mm/sec) in a shape such that adjacent drums constitute a chevron-like shape. As a result, it is possible to alleviate waving of the transfer belt.

In FIG. 11, components of the speed V17 of the transfer belt 17 perpendicular to the moving directions of the photosensitive drum (first image bearing member) 1Y, the photosensitive drum (second image bearing member) 1M, the photosensitive drum 1C, and the photosensitive drum 1K are taken as R171Y, R171M, R171C and R171K, respectively.

The speed components R171Y and R171C are substantially equal to each other, and those R171M and R171K are also substantially equal to each other. More specifically, these speed component values are within ±5% each other. In other words, the sum of the values of R171Y, R171M, R171C and R171K is substantially zero (mm/sec). Here, the term the term "substantially zero" means that the value is within ±0.2 (mm/sec).

In the image forming apparatus of this embodiment, the speed component R171Y in a (first) contact area between the drum 1Y and the transfer belt 17 and the speed component R171M in a (second) contact area between the drum 1M and the transfer belt 17 are substantially equal in magnitude to each other but opposite in direction to each other, i.e., different in direction from each other.

Incidentally, even when the drums are disposed in the above-described chevron-like shape as shown in FIG. 11, the transfer rollers 6Y, 6M, 6C and 6K are disposed in parallel with the opposing drums 1Y, 1M, 1C and 1K, respectively, with respect to their rotational axes.

In the present invention, the image bearing member is not limited to an electrophotographic photosensitive member but may also be an electrostatic recording dielectric member, a magnetic recording magnetic member, etc. The image bearing member may also have a flexible endless belt form, in addition to the drum form. Further, the intermediary transfer member or recording material conveyance member as the transfer medium is not limited to those of a flexible endless belt type but may also be of a drum type or a roller type. The image forming apparatus is not limited to that capable of forming a full-color image but may also be a monochromatic image forming apparatus.

In order to achieve the effect of the present invention, the peripheral speed of the photosensitive drum may suitably be 60-600 (mm/sec), and the intersection angle θ may suitably satisfy, the relationship: 0.29 deg. $\leqq\theta\leqq$2.86 deg.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 352346/2005 filed Dec. 6, 2005, which is hereby incorporated by reference.

What is claimed is:

1. An image forming apparatus comprising:

a rotatable image bearing member for bearing a toner image;

a transfer member for transferring the toner image onto a transfer medium, said transfer member forming a nip with said image bearing member; and transfer member moving means for moving the transfer member so that, in the nip, a movement direction of said transfer medium forms an angle θ with respect to a movement direction of said image bearing member, wherein the angle θ and an absolute value of a peripheral moving speed |V| (mm/see) of said transfer medium satisfy the following relationship:

$$0.36 \leqq |V| \times \sin\theta \leqq 6.5.$$

2. An apparatus according to claim 1, wherein in the nip said transfer medium has a component of speed, in the movement direction of said image bearing member, substantially equal to a moving speed of said image bearing member.

3. An apparatus according to claim 1, wherein said transfer medium is a belt member for carrying the toner image.

4. An apparatus according to claim 3, further comprising a stretching roller, for stretching said belt member, having a rotational axis inclined at an angle with respect to a rotational axis of said image bearing member.

5. An apparatus according to claim 1, wherein said transfer medium is a belt member for carrying a recording material.

6. An apparatus according to claim 5, further comprising a stretching roller, for stretching said belt member, having a rotational axis inclined at an angle with respect to a rotational axis of said image bearing member.

7. An apparatus according to claim 1, said transfer member is disposed in parallel with a rotational axis of said image bearing member.

8. An apparatus according to claim 1, wherein said image bearing member is a first image bearing member contactable with the transfer medium and forming a first nip, and said image forming apparatus further comprising:

a rotatable second image bearing member contactable with the transfer medium and forming a second nip, and wherein a rotational axis of said first image bearing member and a rotational axis of said second image bearing member are inclined at an angle θ with respect to a direction perpendicular to a movement direction of said transfer member.

9. An apparatus according to claim 8, wherein said first image bearing member and said second image bearing member are disposed so that a spacing between an end of said first image bearing member and an end of said second image bearing member is substantially equal to a spacing between the other end of said first image bearing member and the other end of said second image bearing member.

10. An apparatus according to claim 8, wherein said first image bearing member and said second image bearing member are disposed so that a spacing between an end of said first image bearing member and an end of said second image bearing member is different from a spacing between the other end of said first image bearing member and the other end of said second image bearing member.

11. An apparatus according to claim 1, wherein the angle θ is equal to or greater than 0.29 degrees and less than or equal to 2.86 degrees.

* * * * *